United States Patent [19]

Anstett

[11] Patent Number: 4,706,867

[45] Date of Patent: Nov. 17, 1987

[54] NAIL GUIDE AND POSITIONING MEANS FOR A NAILING MACHINE

[76] Inventor: Edgar P. Anstett, Rte. 22, P.O. Box 300, Prairie View, Ill. 60069

[21] Appl. No.: 7,769

[22] Filed: Jan. 28, 1987

Related U.S. Application Data

[63] Continuation-in-part of Ser. No. 802,840, Nov. 29, 1985, Pat. No. 4,657,166.

[51] Int. Cl.[4] ..... B25C 5/06; B25C 1/04

[52] U.S. Cl. ..... 227/130; 227/139; 227/95

[58] Field of Search ..... 227/7, 8, 83, 86, 95, 227/120, 130, 139, 147

[56] References Cited

U.S. PATENT DOCUMENTS

| | | | |
|---|---|---|---|
| 1,655,275 | 1/1928 | La Place | 227/139 X |
| 1,746,496 | 2/1930 | Palmgren | 227/86 |
| 2,423,821 | 7/1947 | Anstett | 227/139 X |
| 3,208,353 | 9/1965 | Wandel | 227/130 X |
| 3,294,303 | 12/1966 | Anstett | 227/95 |
| 3,607,300 | 8/1971 | Anstett | 227/130 X |
| 3,920,169 | 11/1975 | De Caro | 227/95 X |
| 4,380,312 | 4/1983 | Landrus | 227/139 X |
| 4,470,531 | 9/1984 | Anstett | 227/139 X |

FOREIGN PATENT DOCUMENTS

| | | | |
|---|---|---|---|
| 1025044 | 4/1953 | France | 227/95 |

*Primary Examiner*—Paul A. Bell

*Attorney, Agent, or Firm*—Wallenstein, Wagner, Hattis, Strampel & Aubel, Ltd.

[57] ABSTRACT

Improved nail guide and positioning means for use in pneumatically operated and manually operated nailing machines. The nail guide and positioning means acts to maintain each nail, including the last nail, of a nailing strip used in the machine in proper alignment with the nail driving blade of the machine and a workpiece.

10 Claims, 15 Drawing Figures

FIG. 2
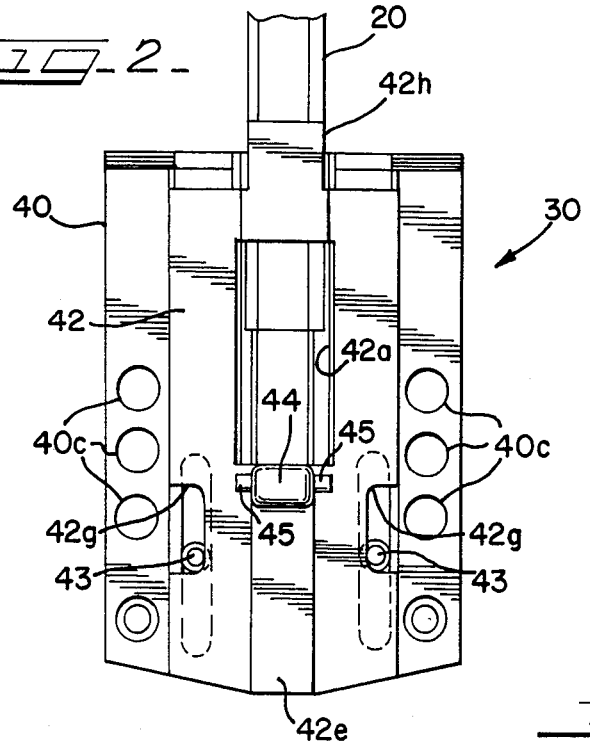
FIG. 6
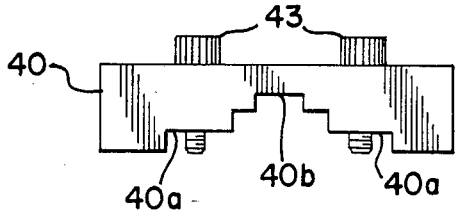
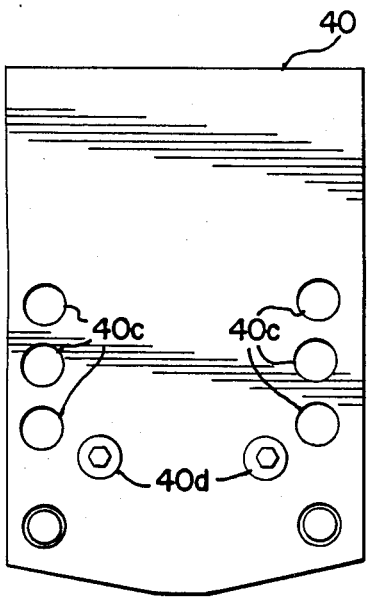
FIG. 3
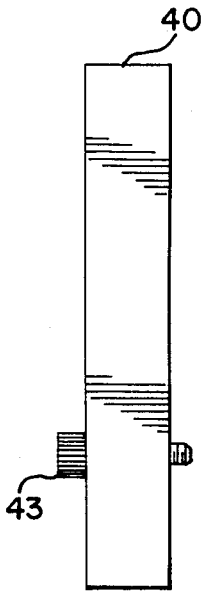
FIG. 4
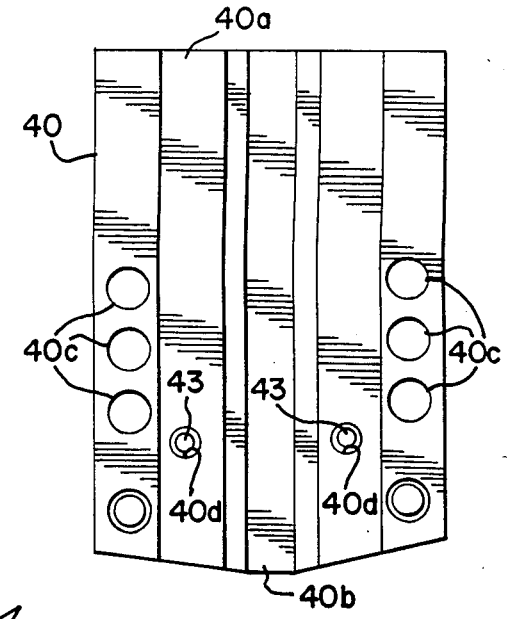
FIG. 5

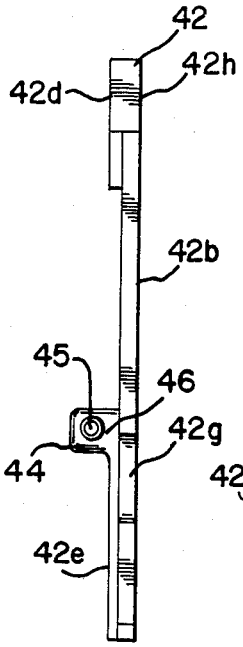
FIG. 7
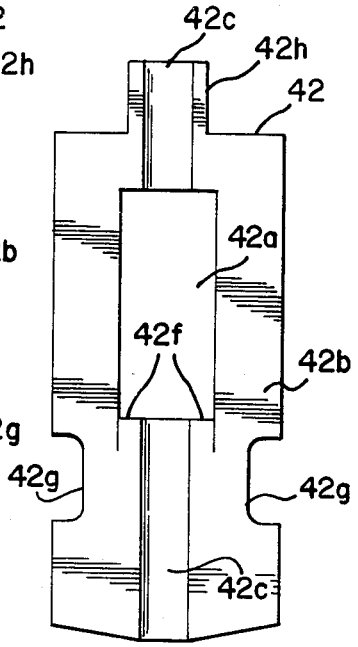
FIG. 8
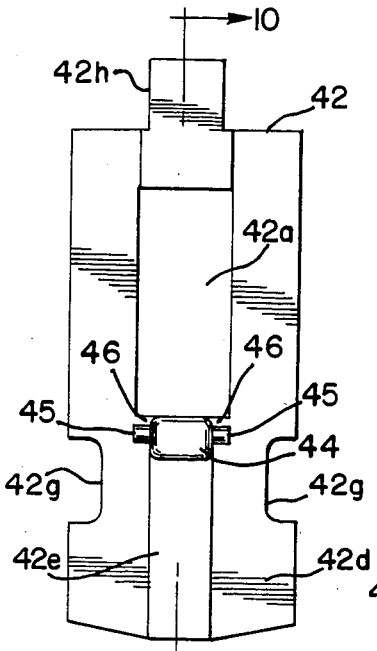
FIG. 9
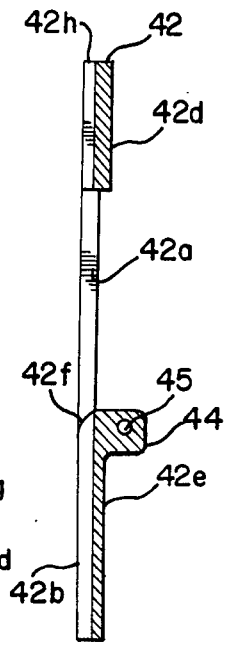
FIG. 10
FIG. 11
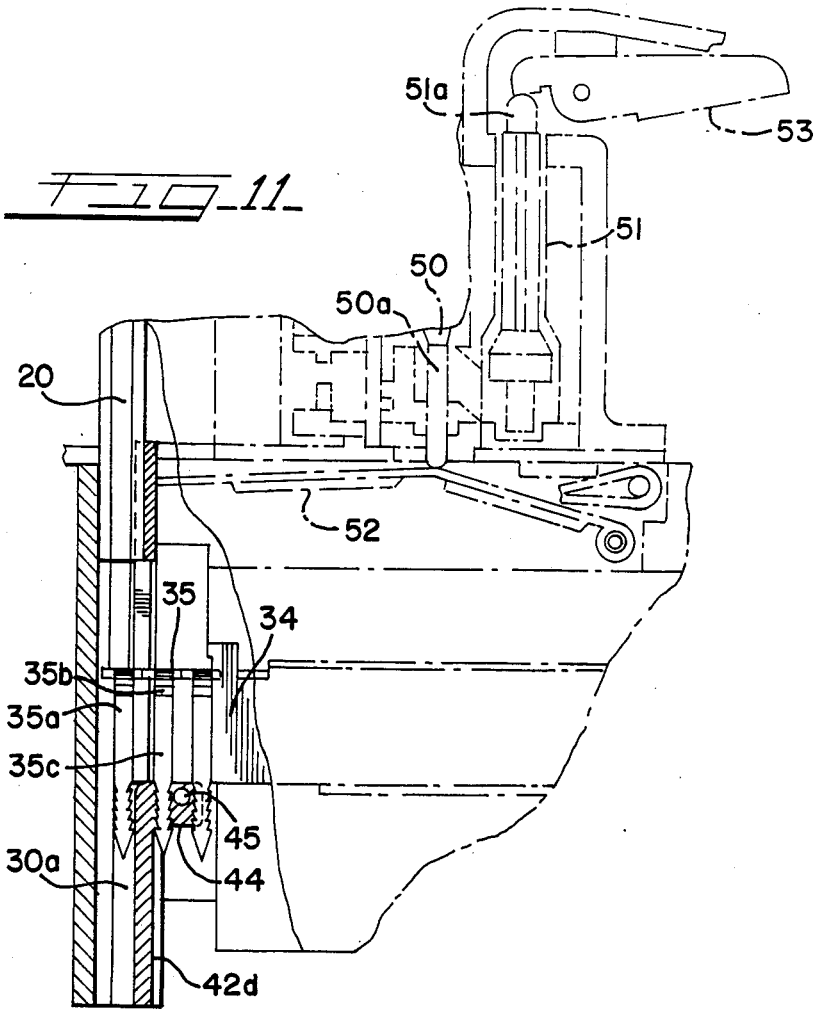

NAIL GUIDE AND POSITIONING MEANS FOR A NAILING MACHINE

This application is a continuation-in-part of pending U.S. patent application Ser. No. 802,840, filed Nov. 29, 1985, now U.S. Pat. No. 4,657,166, directed to "Pneumatically Operated Nailing Machine".

FIELD OF THE INVENTION

The present invention relates to an improved nail guide and positioning means for use in nailing machines of the type which incorporate a reciprocatable blade for driving nails into a workpiece.

BACKGROUND OF THE PRIOR ART

In U.S. Pat. No. 4,621,758, and in pending U.S. patent application Ser. No. 802,840, now U.S. Pat. No. 4,657,166, of which the present application is a continuation-in-part application, nail guide and positioning means are shown which serve to maintain each nail of a nailing strip in proper alignment with the nail driving blade of the machine and a workpiece as the nails are successively and sequentially severed by the nail driving blade. While the nail guide and positioning means shown in said patent and said application are highly effective, and essentially foolproof in the performance of their intended function, on occasion, the last nail of a nailing strip may be bent at a slight angle to the vertical axis of the driving blade by the force exerted on it by the ram or pusher of the nail feeder means of the machine as the penultimate or next to last nail of the nailing strip is being severed and driven into a workpiece by the driving blade. This slight bending of the last nail may cause it to be misaligned with the driving blade and the workpiece as it is moved into position in the nail guide and positioning means by the ram or pusher ready to be driven into a workpiece. Such slight misalignment may cause the last nail to enter the workpiece at an angle, a circumstance which, depending upon the nature of the workpiece, may require extraction of the nail from the workpiece and/or the use of another nail.

BRIEF DESCRIPTION OF THE INVENTION

In accordance with the present invention an improved nail guide and positioning means has been developed for use with the nailing machine disclosed in said pending U.S. patent application Ser. No. 802,840. The nail guide and positioning means of this invention, like the nail guide and positioning means of the nailing machine of said pending application, advantageously comprises a movable plate member and a stationary plate member which are carried on a foot secured to the nailing machine. Unlike the nail guide and positioning means shown in said pending application, the movable plate member of the nail guide and positioning means of the present invention is provided with rearwardly extending nail shank engaging means which eliminates any possibility for the nail shanks of the last nail of a nailing strip, as well as any of the other nails comprising the strip, from being moved out of a vertical plane which is substantially parallel to the vertical axis of the driving blade of the nailing machine as the nail is advanced into the nail guide and positioning means of the machine. As a result every nail comprising a nailing strip will be accurately and unerringly driven into a workpiece by the driving blade of the machine. The construction of the nail guide and positioning means of this invention is such that it is readily and easily adapted for use with the nailing machine disclosed in said pending application, and, with slight modification, for use with the nailing machine of said patent.

BRIEF DESCRIPTION OF THE DRAWINGS

FIG. 2 is a rear view in elevation of an embodiment of the nail guide and positioning means of the present invention;

FIG. 3 is a front view in elevation of the stationary plate member of said embodiment of the nail guide and positioning means;

FIG. 4 is a side view in elevation of the plate member shown in FIG. 3;

FIG. 5 is a rear view in elevation of the plate member shown in FIG. 3;

FIG. 6 is a top plan view of the plate member shown in FIG. 3;

FIG. 7 is a side view in elevation of the movable plate member of said embodiment of the nail guide and positioning means;

FIG. 8 is a front view in elevation of the movable plate member of said embodiment of said means;

FIG. 9 is a rear view in elevation of said movable plate member of said embodiment of said means;

FIG. 10 is a sectional view taken substantially along line 10—10 of FIG. 9;

FIG. 11 is a fragmentary view, partly in section, of said embodiment of the nail guide and positioning means mounted on a nailing machine ghosted in as in FIG. 1;

DETAILED DESCRIPTION OF THE INVENTION

Figure 1:
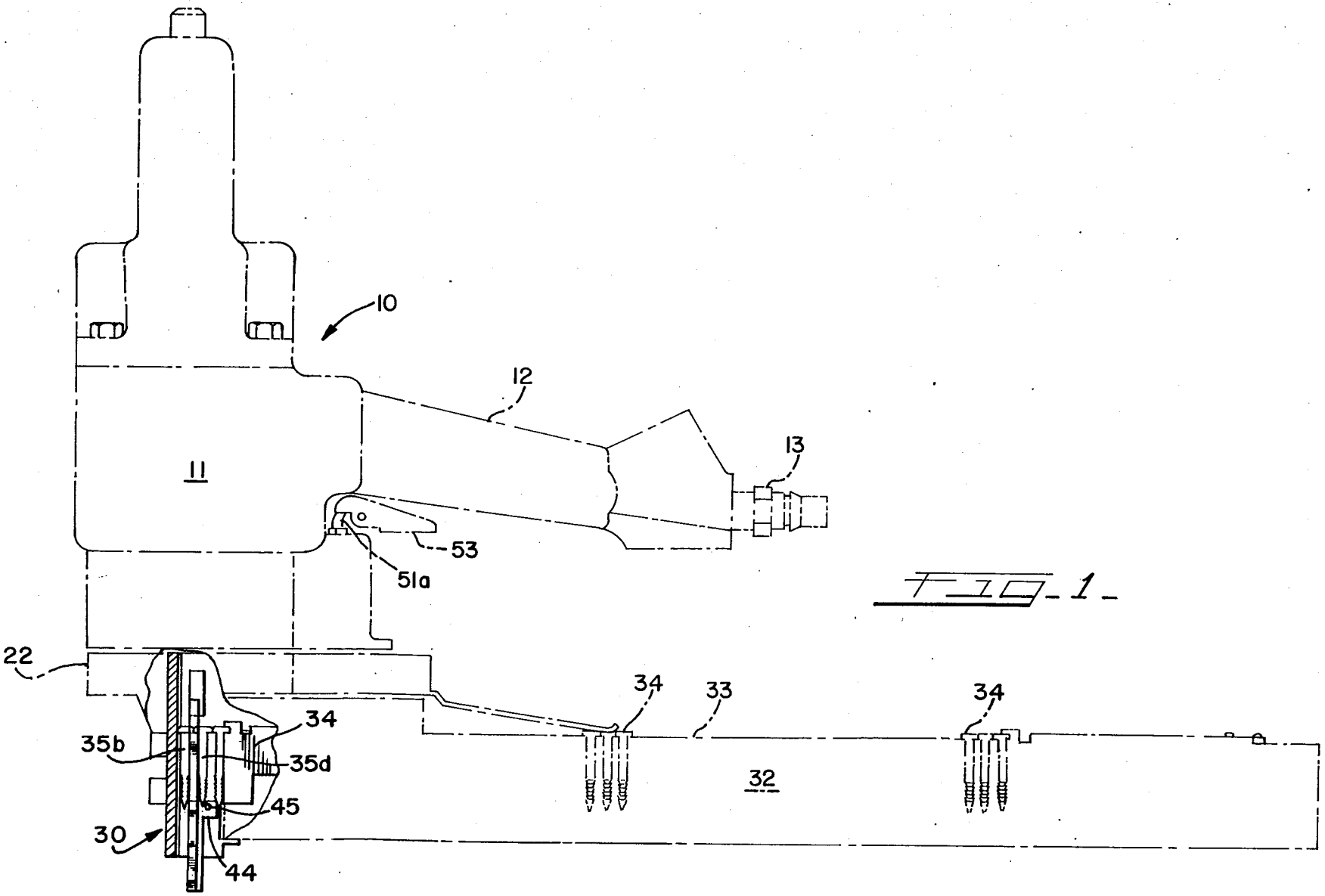
FIG. 1 is a side view in elevation showing an embodiment of the nail guide and positioning means of this invention mounted on a nailing machine, illustrated by broken lines, of the type disclosed in pending U.S. patent application Ser. No. 802,840.
Figure 14:
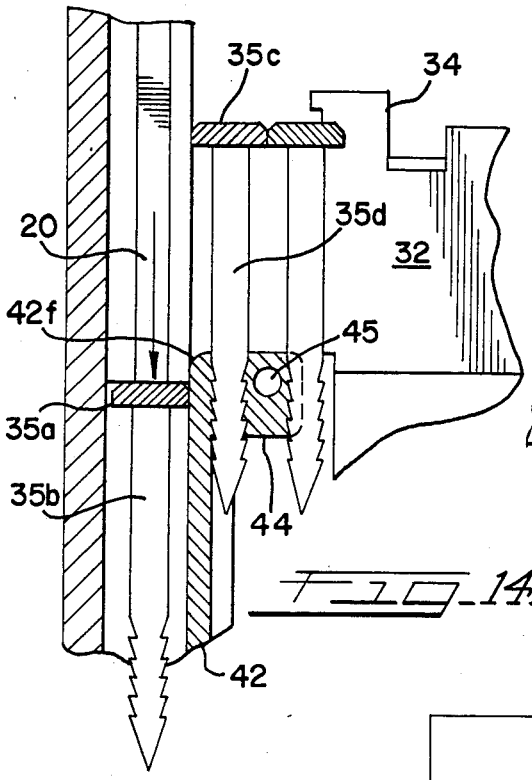
FIG. 14 is an enlarged sectional view showing a severed nail moving downwardly along the nail guide and positioning means, and the nail shank engaging means of the movable plate member in engagement with the shanks of the next-in-line nail of a nailing strip.
Figure 12:
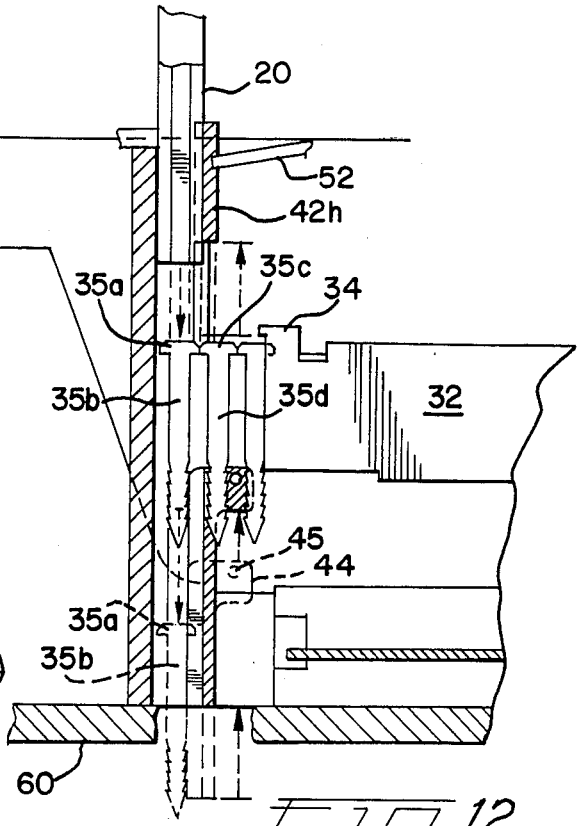
FIG. 12 is a vertical sectional view showing the movable plate member in its nail shank engaging position just prior to a nail of a nailing strip being severed by the driving blade of the nailing machine.
Figure 15:
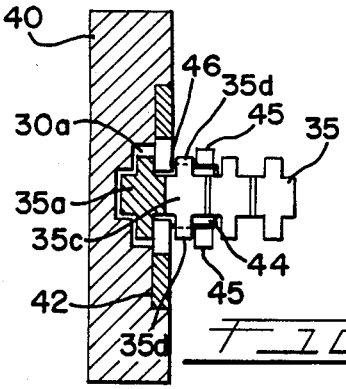
FIG. 15 is a top view, partly in section, showing the position of the nails in a nailing strip with relation to said embodiment of the nail guide and positioning means just before severing of a nail by the driving blade of the nailing machine.
Figure 13:
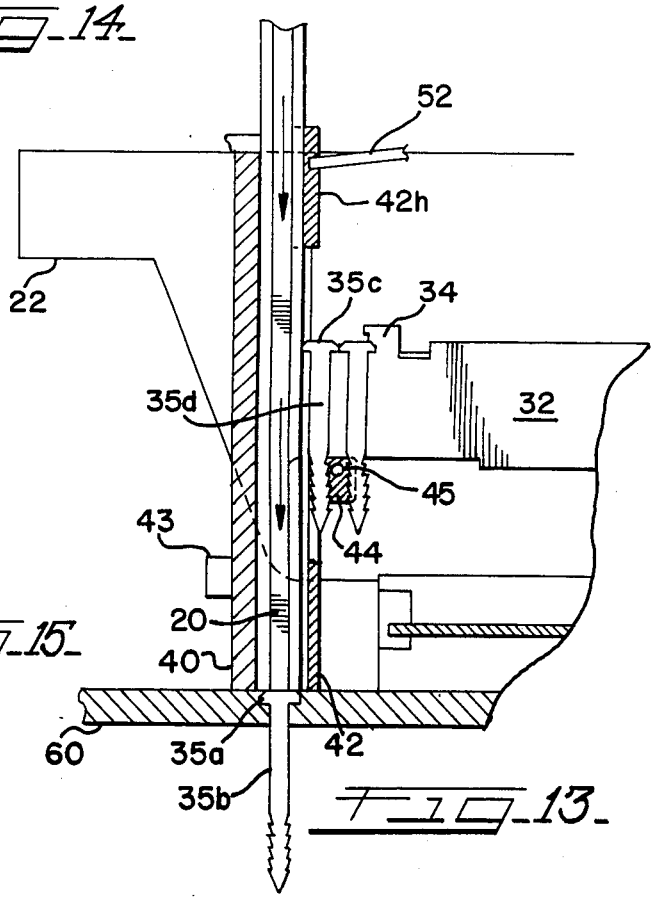
FIG. 13 is a view corresponding to the view of FIG. 12 showing a nail being driven into a workpiece by the driving blade of the nailing machine, and the next nail to be driven still in engagement with the movable plate member.

As indicated hereinabove, the present invention comprises an improvement in the nailing machine disclosed in pending U.S. patent application Ser. No. 802,840. Therefore, to the extent that this invention shares common elements with the nailing machine of said application, those elements, and the function they perform are incorporated herein by reference. Thus, as illustrated in FIG. 1 of the drawings, the improved nail guide and positioning means is shown mounted on a nailing machine, designated generally by reference numeral 10, which, except for said nail guide and positioning means, incorporates all of the elements of the nailing machine of said pending U.S. patent application. As shown, the machine 10 has a hollow housing 11 having a handle portion 12. The handle portion 12 has a cavity to which air under pressure is supplied to a fitting 13. The upper portion of the hollow housing 11 has a cavity which communicates with the cavity of the handle portion 12, and is supplied with air under pressure admitted through the fitting 13. The hollow housing 11 also has a cavity which forms a cylinder for receiving a cylinder sleeve which is reciprocatably mounted in the housing 11. The cylinder sleeve defines an internal cylinder for a reciprocatable differential piston unit which includes a lower, large diameter piston, and an upper small diameter piston. A piston rod connects the two pistons together. The large diameter piston carries a nail driving blade holder having a neck portion on which is engaged the upper end of a nail driving blade 20 (see FIG. 2).

The machine 10, like the machine of said pending U.S. patent application, is provided with a foot plate to which a foot 22 (see FIG. 1) is attached. The foot has a pair of spaced, downwardly extending side flanges which are joined along their rear margins to a slotted rear wall to which is secured the improved nail guide and positioning means of this invention, designated generally by reference numeral 30 in the drawings. The foot 22 also provides support for the nail feeder mechanism 32. Like the feeder mechanism of said pending U.S. patent application, the mechanism 32 includes a nail guide track 33 and a spring actuated pusher 34 for urging a nailing strip 35 along the track 33.

The nail guide and positioning means 30 of the present invention, like the nail guide and positioning means of the nailing machine disclosed in said pending U.S. patent application, comprises a stationary front plate member 40 and a cooperating movable back plate member 42. As best illustrated in FIGS. 3–6, the stationary plate member 40 is recessed at 40*a* to receive the movable plate member 42. This arrangement enables the plate member 42 to be moved from an extended position to a retracted position when the plate member 42 is placed against a workpiece. The stationary plate member 40 also is provided with a longitudinal central recess 40*b* which is configured to accommodate the shape of the nail driving blade 20. A series of vertically spaced bores 40*c* are provided along each margin of the stationary plate member 40 for receiving screws for securing the nail and guide positioning means 30 to the foot 22. The stationary plate member 40 is also provided with a pair of tapped bores 40*d* positioned in horizontal, aligned relation to one another in the recess 40*a*. The bores 40*d* each receive a knurled headed screw 43, the function of which will become clear as the description proceeds.

The movable back plate member 42 of the nail guide and positioning means 30 is provided with an elongated gate or slot 42*a* for admitting a nail 35*a*, having nail shanks 35*b*—35*b*, from the nailing strip 35 into position to be severed when the plate member 42 is in its extended position, and then driven into a workpiece by the driving blade 20 when the plate member 42 is in its retracted position. On the inner wall 42*b* of the movable plate member 42, extending from the ends of the slot 42*a*, a channel or recess 42*c* is provided. The recess 42*c* and the recess 40*b* of the stationary plate member 40 cooperate to provide a guideway 30*a* for the driving blade 20.

The outer wall 42*d* of the movable plate member 42 has a raised central portion 42*e* at the upper end of which is provided with a nail shank engaging extension or boss 44. The boss 44 is positioned at the lower end of the slot 42*a* of the movable plate member 42, and is provided with a pair of laterally extending arms 45—45 positioned in spaced relation to the outer wall 42*d* of the plate member 42 thereby forming a nail shank receiving space 46 on each side of the boss 44. In the embodiment of the plate 42 shown, the arms 45—45 comprise the ends of a pin press fitted into a transverse bore in the boss 44. The width of the boss 44 is such that it can be received between the shanks 35*d*—35*d* of a nail 35*c* of the nailing strip 35 next in line to be driven into a workpiece when the movable plate member 42 is in its retracted position as shown in FIG. 11. The dimensions of the spaces 46 formed by the arms 45—45 and the outer wall 42*d* of the plate member 42 are such that the nail shanks 35*d*—35*d* of the nail 35*c* next in line to be driven into a workpiece are snugly held therein when the plate member 42 is in its retracted position.

In order to insure positive engagement of the nail shanks 35*d*—35*d* of the nail 35*c* in the spaces 46 when the plate member 42 is moved to its retracted position, the lower margin 42*f* of the slot 42*a*, on each side of the recess 42*c*, is chamfered or beveled as best illustrated in FIGS. 8 and 10. The beveled lower margin 42*f* enables the plate member 42 to unerringly intercept the pointed shanks 35*d*—35*d* of the nail 35*c* next in line to be fed into the driving blade guideway 30*a* formed by the recesses 40*b* and 42*c* of the plate members 40 and 42.

The movable back plate member 42 advantageously is provided with an elongated notch 42*g* along its side margins for receiving the threaded shanks of the knurled headed screws 43 by means of which the plate members 40 and 42 are attached to one another. The ends of the notches 42*g* define the limits of the longitudinal movement of the movable back plate member 42 along the recess 40*a* of the stationary front plate member 40. The movable back plate member 42 also is provided with a valve activating extension 42*h*, the function of which will become clear as the description proceeds.

Again, as stated hereinabove, except for the nail guide and positioning means 30 of the present invention, all of the elements of the nailing machine 10, as shown in FIG. 1 of the drawings, are the same as those of the nailing machine shown and described in said pending patent application Ser. No. 802,840. That statement, of course, applies to the control valve of the machine 10, a portion of which is shown in FIG. 11 of the drawings. The portion of the valve assembly illustrated includes valves 50 and 51, a lever 52 which is in contact with the stem 50*a* of the valve 50, and a pivotable trigger 53 which is in contact with the fluted valve stem 51*a* of the valve 51. When the movable back plate member 42 is placed gainst an object into which a nail is to be driven, the valve actuating extension 42*h* of the plate member 42 pivots the lever 52 upwardly unseating the valve 50. This has the effect of interrupting the flow of pressurized air to the area below the cylinder sleeve in the housing 11 of the nailing machine 10. When the trigger 53 is depressed, the valve 51 is closed. As a result, the differential piston unit of the machine is driven downwardly to advance the blade 20 to drive a nail severed from the nailing strip into a workpiece.

Referring, now, in greater detail to FIGS. 12–15 of the drawings, when the movable plate member 42 of the nail guide and positioning means 30 of the present invention is placed against a workpiece 60, and a nail 35*a* has been advanced through the gate or slot 42*a* of the plate member 42, the member 42 moves a distance approximately equal to the length of the notches 42*g* formed in the side margins of the member 42. As the member 42 moves, the beveled lower margin 42*f* of the slot 42*a* contacts and rides along the shanks 35*b*—35*b* of the nail 35*a* positioned in the guideway 30*a* below the driving blade 20. At the same time, the shanks 35*d*—35*d* of the nail 35*c* next in line, which nail could be the last nail to be driven into the workpiece 60, are guided into the spaces 46 formed between the outer wall 42*d* of the plate member 42 and the arms 45—45 on the sides of the boss 44. The holding action on the shanks 35*d*-35*d* provided by the arms 45—45 maintains the shanks 35*d*-35*d* in rigid, substantially parallel relation with respect to the vertical axis of the guideway 30*a* and the driving blade 20 as the blade 20 drives the nail 35*a* into the workpiece 60. This holding action acts to resist any forces applied to the nail shanks 35*d*-35*d* and the head of the nail 35*c* by the pusher 34 which may tend to bend the shanks 35*d*—35*d* of the nail 35*c* in a manner to misalign it with the guideway 30*a* and/or the blade 20. Thus, when the nail 35*b* is advanced into the guideway 30*a* it will be in proper position to be accurately and unerringly driven into the workpiece 60 by the blade 20.

While the invention has been described with relation to its use in a nailing machine of the type disclosed in pending U.S. patent application Ser. No. 802,840, it can, as stated hereinabove, be utilized with only minor modification in a nailing machine of the type disclosed in U.S. Pat. No. 4,621,758. Further in this same connection, while for purposes of illustration, one preferred form of the invention has been disclosed, other forms of the invention may become apparent to those skilled in the art and, therefore, this invention is to be limited only by the scope of the appended claims.

What is claimed is:

1. In a nailing machine having a reciprocatable blade for sequentially severing and driving nails from a nailing strip into a workpiece; a foot secured to the nailing machine below the reciprocatable blade; nail guide and positioning means attached to the foot, said nail guide and positioning means including a stationary plate member and a movable plate member, said movable plate member being movable between a normally extended nail receiving position and a nail contacting position; and nail feeder means for sequentially advancing nails in strip form into the nail guide and positioning means; the improvement wherein the movable plate member of the nail guide and positioning means is provided with rearwardly extending nail shank engaging means for maintaining the nail shanks of each nail of the nailing strip preceding the nail to be severed and driven into a workpiece in substantially parallel relation to the vertical axis of the driving blade, said nail shank engaging means further acting to resist any forces exerted by the nail feeder means on the nails of the nailing strip from changing the position of the nail shanks of said preceding nail with relation to the vertical axis of the driving blade.

2. In a nailing machine according to claim 1 wherein the nail shank engaging means comprises an extension joined to the outer wall of the movable plate member, said extension being provided with side members which cooperate with the outer wall of the movable plate member to rigidly maintain the nail shanks of the nail preceding the nail to be severed and driven into a workpiece in substantially parallel relation to the vertical axis of the driving blade when the movable plate member is in its nail contacting position.

3. In a nailing machine according to claim 2, wherein the extension comprises a boss provided with laterally extending arms, said arms being positioned in spaced relation to the outer wall of the movable plate member a distance sufficient to receive therebetween the shanks of a nail comprising the nailing strip.

4. In a nailing machine according to claim 3, wherein the boss is provided with a transverse bore for receiving a pin, the ends of which extend laterally outwardly from the sides of the boss.

5. In a nailing machine according to claim 2 wherein the movable plate member is provided with a slot for admitting nails from the nail feeder means into the nail guide and positioning means, the lower margin of said slot being beveled to facilitate contact of the nail shanks of a nail with the nail shank engaging means.

6. In a pneumatically operated nailing machine having a reciprocatable blade for driving nails in the form of a nailing strip when advanced; a reciprocatable differential piston for advancing and retracting the reciprocatable blade, the reciprocatable differential piston having a lower, large diameter piston and an upper, small diameter piston; a piston rod for the reciprocatable differential piston; a reciprocatable cylinder sleeve having a cylinder for receiving the lower, large diameter piston; a cylinder member having a cylinder for receiving the upper, small diameter piston; passages for conveying air under pressure beneath the upper, small diameter piston and for venting to atmosphere air above the lower, large diameter piston to drive the reciprocatable differential piston upwardly and to retract the reciprocatable blade, and for interrupting the venting of air to atmosphere from above the lower, large diameter piston, and for supplying air under pressure above the lower, large diameter piston to drive the reciprocatable differential piston downwardly to advance the reciprocatable blade; control valve means for selectively supplying air under pressure to said passages; a foot secured to the nailing machine below the reciprocatable cylinder sleeve and the lower, large diameter piston through which the reciprocatable blade extends; nail guide and positioning means attached to the foot, said nail guide and positioning means including a stationary plate member and a movable plate member, said movable plate member being movable between a normally extended nail receiving position and a nail contacting position; and nail feeder means for sequentially advancing nails into the nail guide and positioning means; the improvement wherein the movable plate member of the nail guide and positioning means is provided with rearwardly extending nail shank engaging means for maintaining the nail shanks of each nail of a nailing strip preceding the nail to be severed and driven into a workpiece in substantially parallel relation to the vertical axis of the driving blade.

7. In a nailing machine according to claim 6 wherein the nail shank engaging means comprises an extension joined to the outer wall of the movable plate member, said extension being provided with side members which cooperate with the outer wall of the movable plate member to rigidly maintain said nail shanks in a position substantially vertical to the longitudinal axis of the nailing strip.

8. In a nailing machine according to claim 7 wherein the extension is a boss formed on the outer wall of the movable plate memer, said boss being provided with arms positioned in spaced, parallel relation to the surface of the outer wall.

9. In a nailing machine according to claim 8 wherein the boss is provided with a transverse bore for receiving a pin, the ends of which extend outwardly from the side walls of the boss.

10. In a nailing machine according to claim 7 wherein the movable plate member is provided with control valve engaging means for effecting activation of the reciprocatable differential piston of the nailing machine.

* * * * *